United States Patent [19]

Perrenoud

[11] 4,261,396

[45] Apr. 14, 1981

[54] MACHINE FOR STRAIGHTENING METAL WIRE

[76] Inventor: René Perrenoud, 2114 Fleurier, Switzerland

[21] Appl. No.: 941,376

[22] Filed: Sep. 12, 1978

[30] Foreign Application Priority Data

Sep. 16, 1977 [CH] Switzerland ..... 11327/77

[51] Int. Cl.[3] ..... B21F 1/02

[52] U.S. Cl. ..... 140/147; 242/80; 242/158.2

[58] Field of Search ..... 140/147, 140; 72/183; 242/7.09, 80, 82, 128, 158.2, 158.4 R

[56] References Cited

U.S. PATENT DOCUMENTS

| | | | |
|---|---|---|---|
| 1,848,982 | 3/1932 | Webb | 242/128 |
| 1,881,019 | 10/1932 | McFarland | 242/80 |
| 3,212,947 | 10/1965 | Vanzo | 140/149 |
| 4,083,515 | 4/1978 | Dickerson | 242/158.2 |

FOREIGN PATENT DOCUMENTS

| | | | |
|---|---|---|---|
| 720807 | 12/1954 | United Kingdom | 242/158.4 R |

*Primary Examiner*—Lowell A. Larson
*Attorney, Agent, or Firm*—Robert E. Burns; Emmanuel J. Lobato; Bruce L. Adams

[57] ABSTRACT

A machine for straightening metal wire comprises a wire unwinding device rotatable about an axis which is at right-angles to the axis of rotation of a drum forming a part of the unwinding device and which passes through guide means at the outlet of the unwinding device such that this axis coincides with the trajectory of the unwound wire. The machine also comprises means for straightening the wire and means for winding the straightened wire comprising a small drum and a large drum mounted on drive shafts drivable in a helical movement with a pitch corresponding to the width or the diameter of the straightened wire, in order to obtain uniform close helical winding on the drum without overlapping. The winding drum may be retracted when not in use.

The machine makes it possible for wire of small diameter or thickness to be straightened continuously, in particular for the manufacture of springs for clock-making.

5 Claims, 8 Drawing Figures

MACHINE FOR STRAIGHTENING METAL WIRE

The invention relates to a machine for straightening metal wire.

Machines are known in which the wire is drawn through straightening means. It is also known to rotate a wire unwinding device about an axis located in its own plane in order to compensate for the twisting of the wire (for example, the ESCO REDRESS-O-MATIC machine). However, in this machine the wire is drawn by means of grippers and cut into discrete lengths. Thus, a machine of this type cannot operate continuously. Furthermore, it is not able to straighten a flat wire. In view of the fact that the wire is cut after a certain length has been straightened, it is not possible to operate continuously.

The object of the present invention is to provide a machine which can continuously straighten both round wires and flat wires, and specifically very fine wires made of any alloy.

The term "continuous" is relative and in this specification is intended to mean that an entire reel of wire is straightened, which may represent several hundred kilometers for very fine wire. In particular, the invention provides a machine specifically intended to straighten round wire having a diameter of between 0.03 mm and 1 mm and flat wire having a minimum thickness of 0.01 mm and a width of 2 mm.

According to the present invention there is provided a machine for straightening metal wire comprising a wire unwinding device rotatable about an axis which is perpendicular to the axis of rotation of a drum forming a part of the unwinding device and which passes through means for guiding the wire located at the outlet of the unwinding device such that said axis coincides with the trajectory of the unwound wire, wire straightening means, and means for winding the straightened wire comprising a winding drum mounted on a drive shaft drivable in a helical movement with a pitch corresponding to the width or the diameter of the straightened wire in order to obtain uniform close helical winding of the wire on the winding drum without overlapping.

An example of the present invention will now be described with reference to the accompanying drawings, in which.

Figure 1:
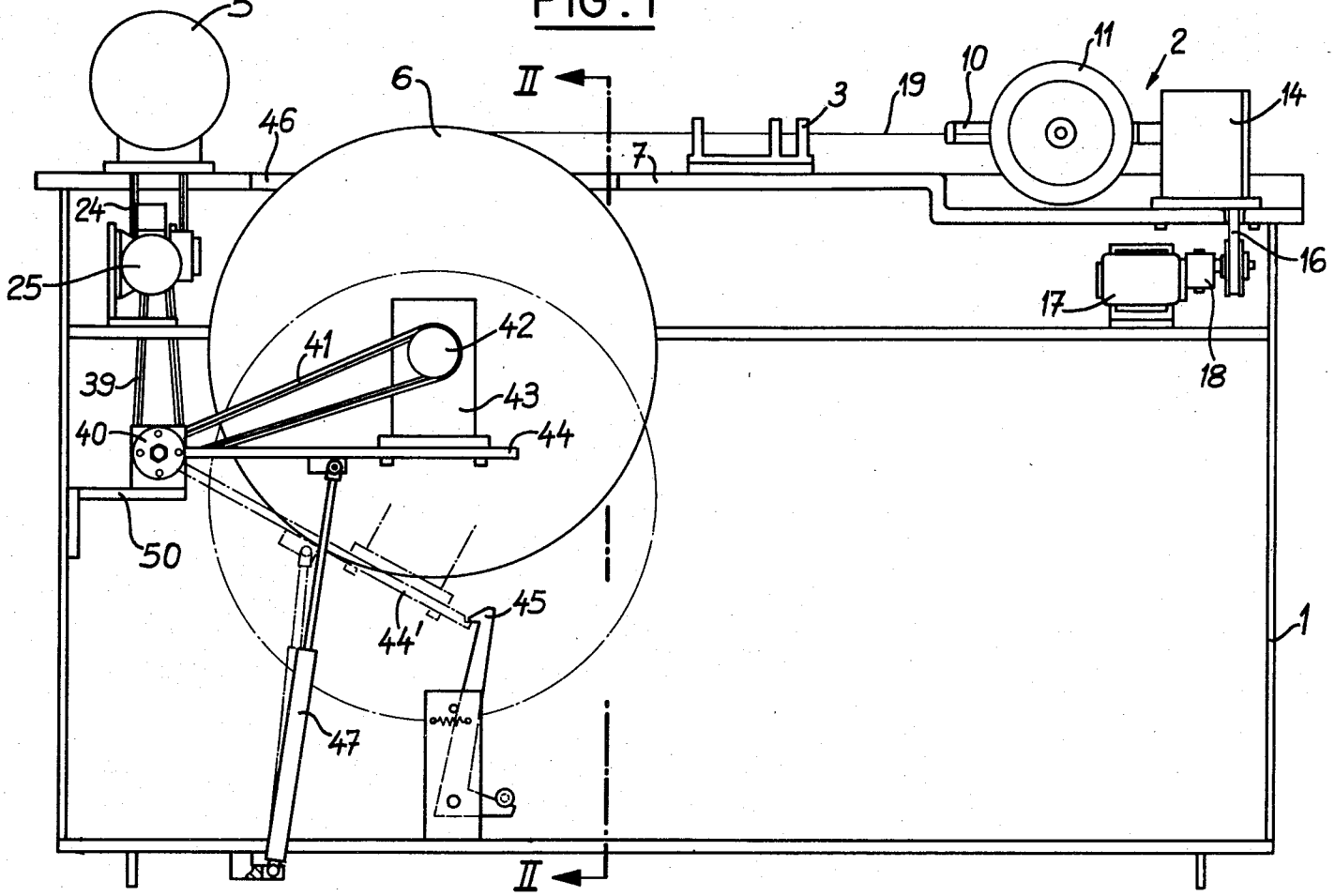
FIG. 1 is a side elevation of a machine according to the invention in section on line I—I of FIG. 3.
Figure 2:
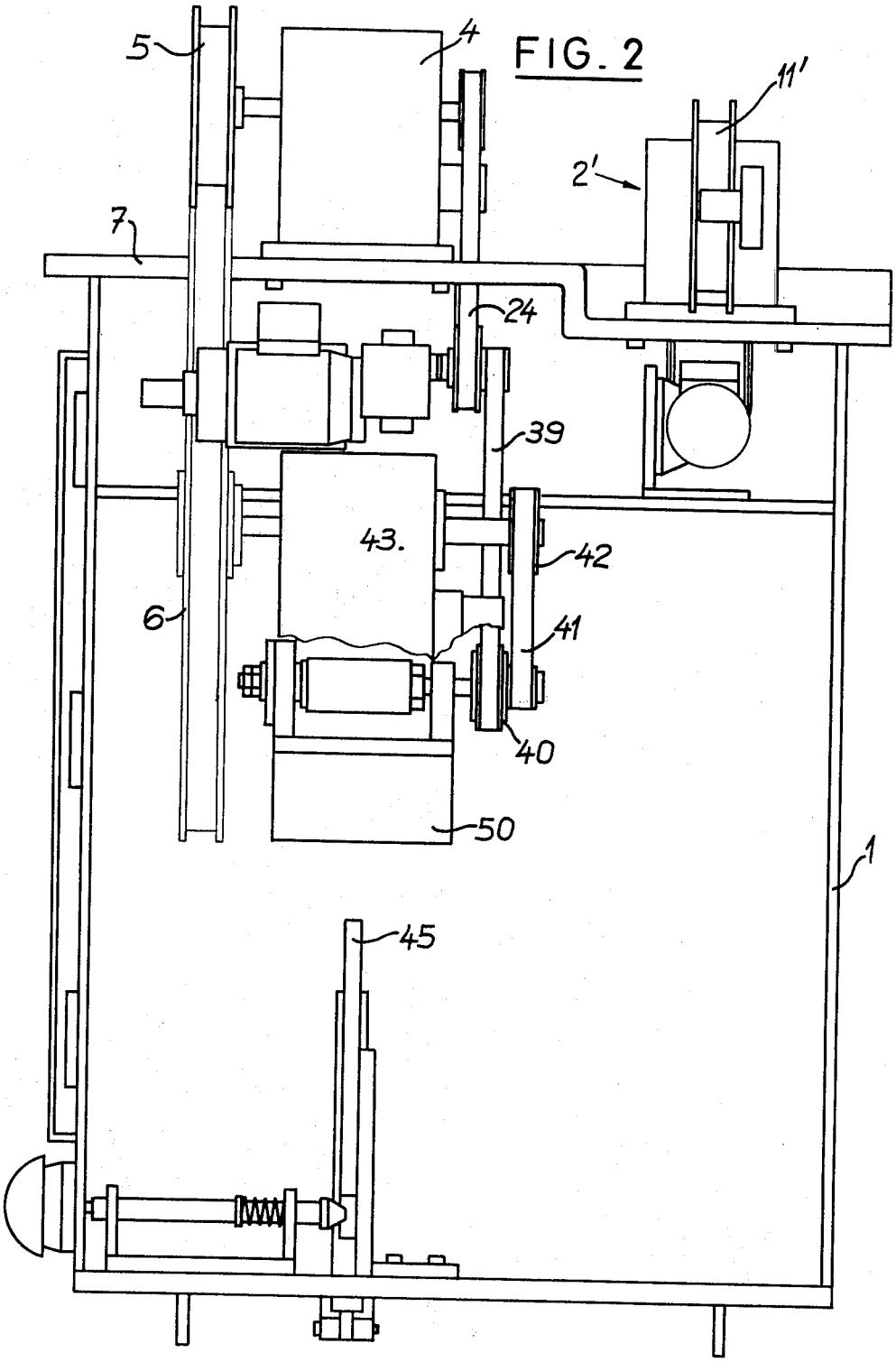
FIG. 2 is a front elevation of the machine in section on line II—II of FIG. 1.
Figure 3:
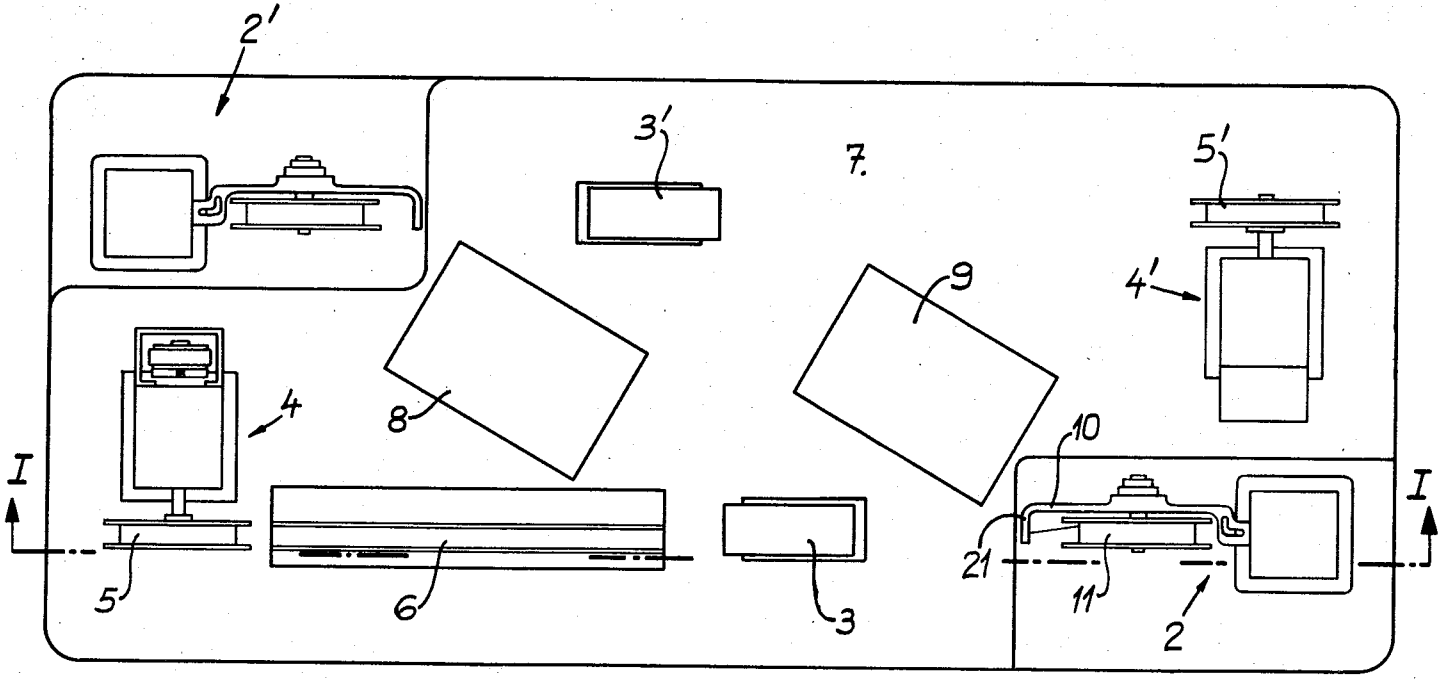
FIG. 3 is a plan view of the machine.

Reference will be made to FIG. 1. The machine comprises a frame 1 on which are mounted an unwinding device 2, a straightening device 3 comprising rollers, means 4 for winding the straightened wire comprising a first drum 5 and a second winding drum 6 of greater diameter and which can be retracted underneath the table. FIG. 3 shows that the machine comprises two systems operating in parallel, i.e. a second unwinding device 2′ identical to the unwinding device 2 and second winding means 4′. The second device operates in the opposite direction and has no large winding drum. The machine comprises two electronic control boxes 8 and 9 respectively associated with each system.

Figure 4:
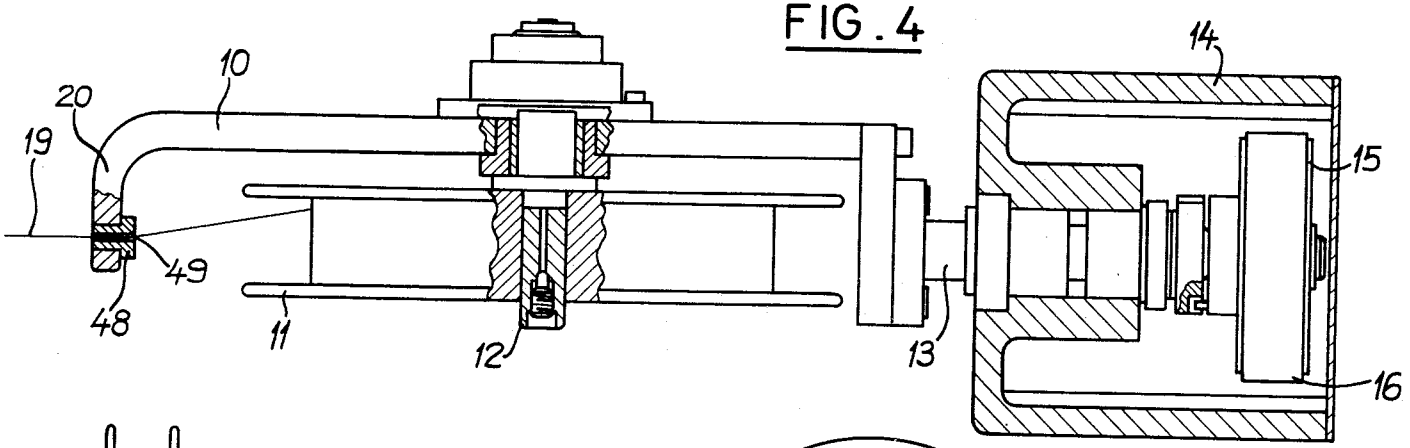
FIG. 4 is a plan view of an unwinding device of the machine.
Figure 5:
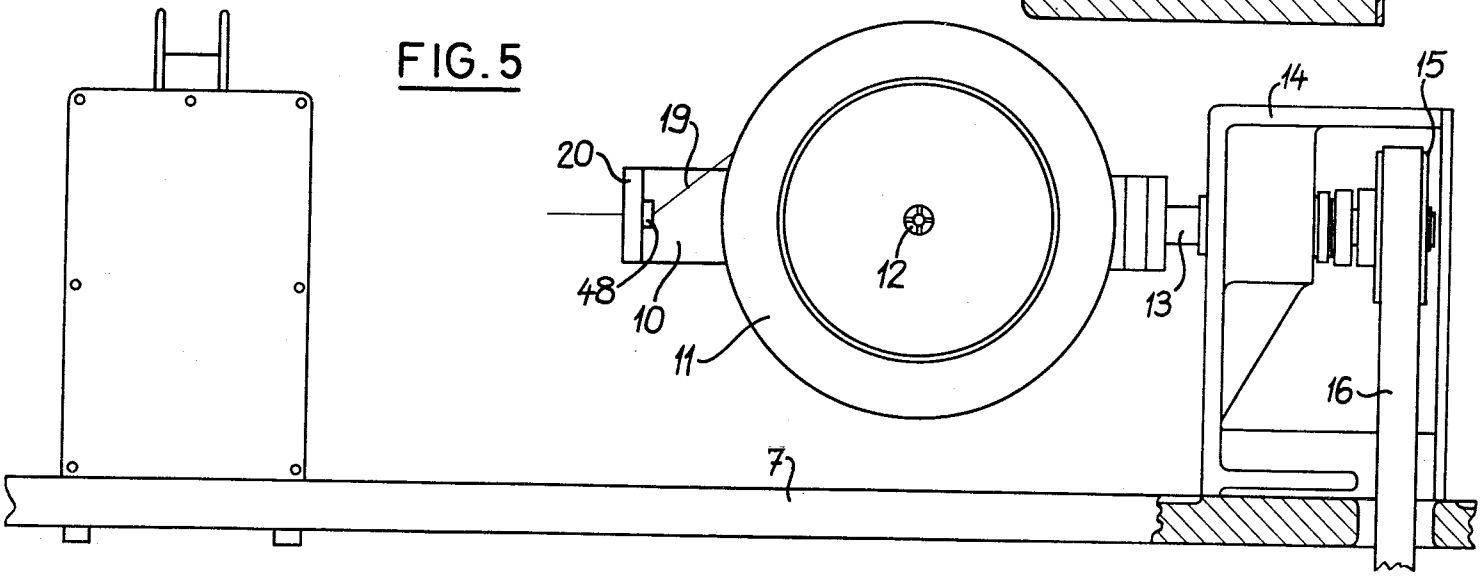
FIG. 5 is an elevation of the unwinding device.

The unwinding device 2 comprises a bent arm 10 on which a reel of wire 11 to be straightened is mounted by means of an expandable socket 12 (FIG. 4). The support 10 is integral with a shaft 13 whose axis passes through the axis of symmetry of the reel 11 and cuts the axis of rotation of this reel 11 at right-angles. The shaft 13 is pivoted in a frame 14 by means of ball bearings and it supports a pinion 15 meshing with which is a toothed belt 16 driven by a motor 17 (FIG. 1) through speed reduction gearing 18. The support 10 is thus rotated about the axis of shaft 13 in either direction at an adjustable and programmable speed. The end 20 of the support 10 is free and bent at right-angles. It comprises a part 48 made from hard metal provided with a bore 49 whose axis coincides with the axis of rotation of shaft 13 and through which the unwound wire 19 passes.

Figure 6:
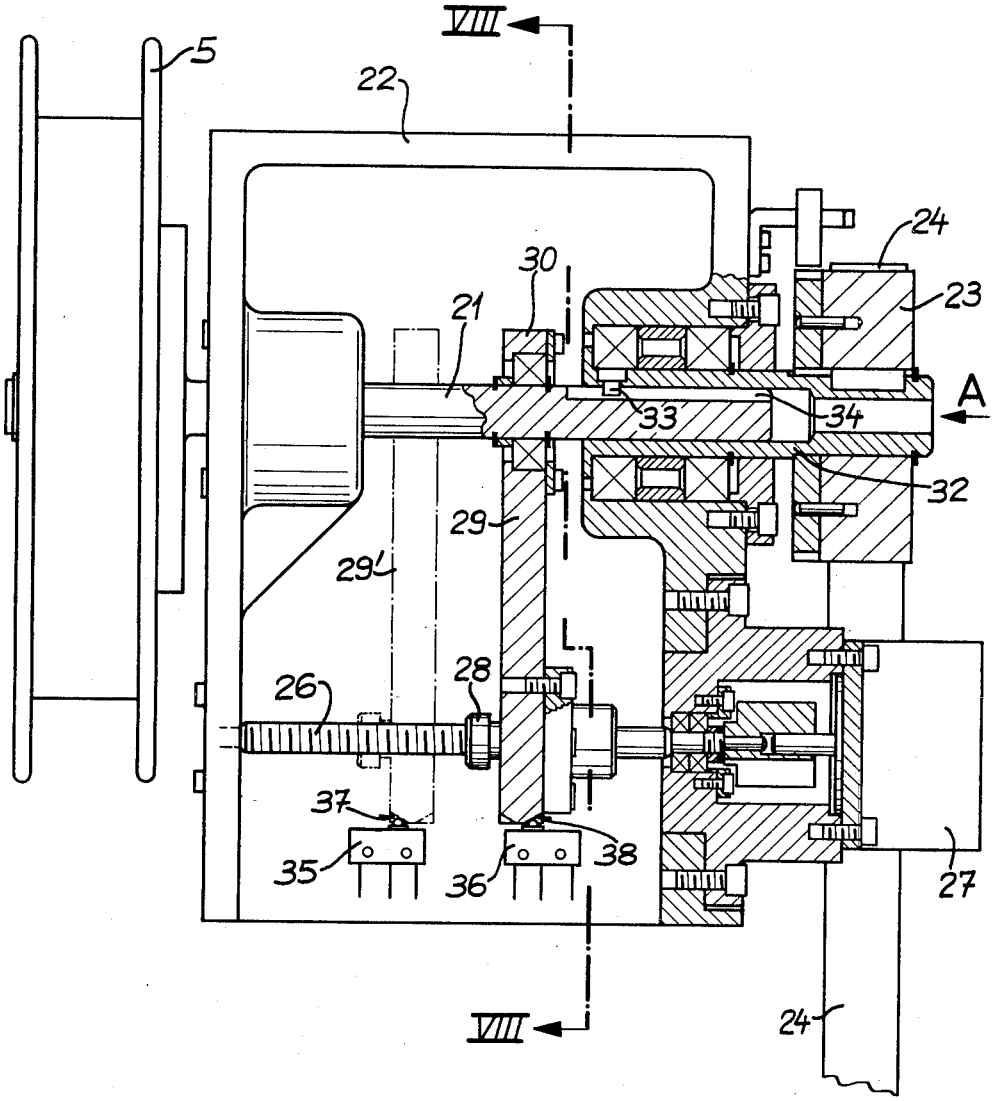
FIG. 6 is a sectional view of winding means of the machine.
Figure 7:
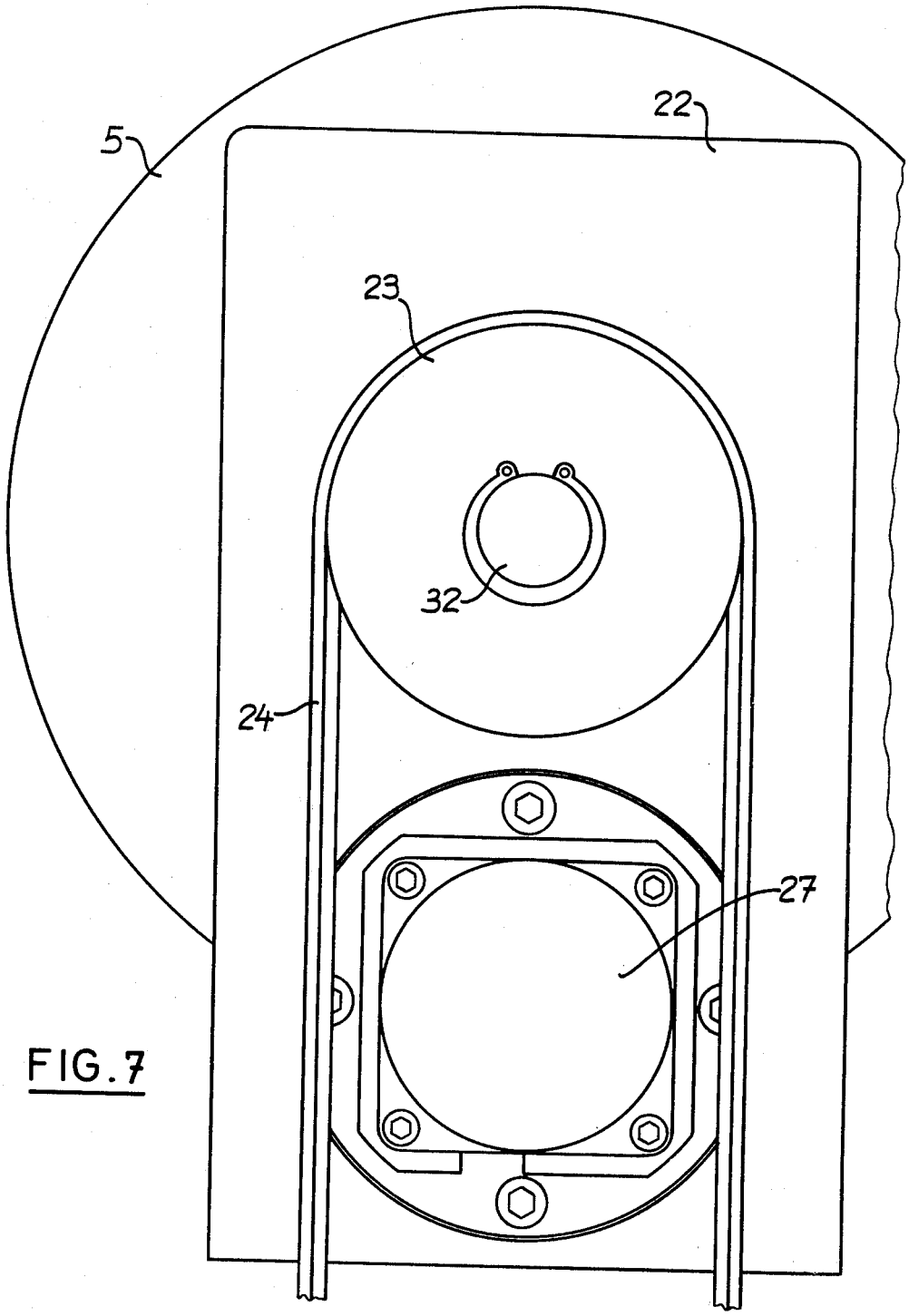
FIG. 7 is an elevation of the winding means in direction A of FIG. 6.
Figure 8:
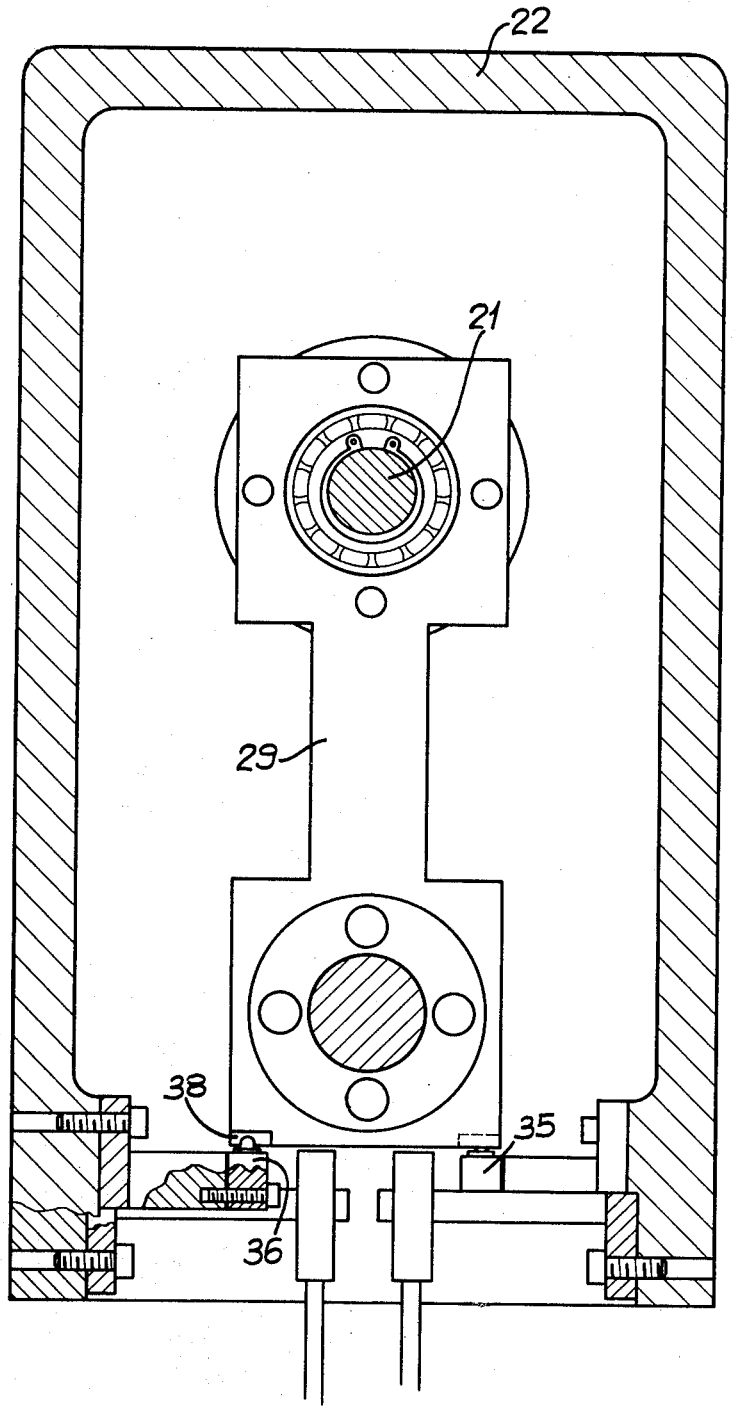
FIG. 8 is a sectional view on line VIII—VIII of FIG. 6.

The straightening devices 3 comprising rollers are constituted by one or more sets of three fixed or rotary rollers, between which the wire to be straightened passes. These devices can be removed and are interchangeable. One of the rollers is fixed whereas the position of the two other rollers can be adjusted depending on the thickness of the wire. These straightening devices are known per se. The winding means are shown in detail in FIGS. 6 to 8. The winding drum 5 is fixed in a detachable manner on a shaft 21 pivoted in a frame 22 and comprising at its end a pinion 23 driven by a toothed belt 24 driven by a motor 25 (FIG. 1). The frame 22 also supports a worm 26 driven by means of a stepping motor 27 and supporting a movable nut 28 integral with a connecting part 29 whose upper end is connected to the shaft 21 by means of a ball bearing 30 axially integral with the shaft 21. The part 29 is thus axially integral with the shaft 21. The shaft 21 may slide in a shaft 32 which supports the pinion 23 and which is connected to rotate with the shaft 21 by a cotter pin 33 engaging in a longitudinal groove 34 in the shaft 21. The lower end of the part 29 comprises two opposed ramps 37, 38 working respectively with end-of-travel switches 35 and 36 connected in an electrical control circuit. The part 29 driven by the nut 28 carries out a reciprocating movement between positions 29 and 29′. The winding drum 5 is thus driven in a helical movement in one direction then in the other, the pitch of the helix being determined by the stepping motor 27 depending on the wire to be wound, such that the wire winds uniformly in a helix, in a close manner, without overlapping. This is particularly important for flat wire, but also for round wire, since overlapping would re-introduce a twist. The wire wound on the reel drum 5 is thus a perfectly straightened wire which is ready to be introduced into a machine, for example a machine for manufacturing springs.

The toothed belt 24 is driven by a motor 25 (FIG. 1) which also drives by means of a toothed belt 39, a pulley 40 mounted on a bracket 50 and a toothed belt 41, a pinion 42 identical to the pinion 23 integral with the shaft of the winding drum 6. The arrangement 43 is identical to the arrangement illustrated in FIGS. 6 to 9, with the sole difference that the winding drum 6 has a substantially greater diameter than that of the drum 5. The assembly 43 is also mounted on a pivoted support 44 controlled by a pneumatic jack 47 such that it can be retracted below the level of the table 7 into the position 44' in which it is held by a hook 45. In the working position, the drum 6 passes through an opening 46 in the table 7. One uses a small winding drum 5 or a large winding drum 6 depending on the characteristics of the wire to be straightened, i.e. depending on its rigidity and elasticity, so as not to exceed its elasticity limit so that the wire is not once more given a permanent deformation.

I claim:

1. A machine for straightening metal wire comprising:

a wire unwinding device comprising support means for rotatably supporting a reel of wire, means rotatably mounting said support means for rotation about an axis bisecting and perpendicular to the axis of rotation of said reel, drive means for rotating said reel support means about its axis of rotation in either direction at an adjustable and programmable speed, and guide means in alignment with the axis of rotation of said reel support means for guiding wire as it is unwound from said reel, straightening means for straightening wire unwound from said reel, and take-up means for continuously drawing wire from said reel and through said guide means and straightening means, said take-up means comprising two winding drums of different diameter, means for rotatably supporting said drums, and means for driving said drums, said drum driving means comprising a single motor and means for driving each of said drums by said single motor, said means for rotatably supporting one of said drums comprising an arm pivoted coaxially with said single motor, means on said arm rotatably supporting said one drum, and means for swinging said arm about its pivot to move said one drum between an active position for taking-up said wire and an inactive position.

2. A machine according to claim 1, in which said reel support means comprises a shaft rotatably supported by said mounting means and a bent arm carried by said shaft and having a portion offset from the axis of rotation of said shaft, and means on said offset portion for rotatably supporting said reel, said bent arm having an in-turned end portion supporting said guide means.

3. A machine according to claim 2, in which said drive means for said reel support means comprises a pinion on said shaft and reversible and variable speed motor means driving said shaft through said pinion.

4. A machine for straightening metal wire comprising:

a wire unwinding device comprising support means for rotatably supporting a reel of wire, means rotatably mounting said support means for rotation about an axis bisecting and perpendicular to the axis of rotation of said reel, drive means for rotating said support means about its axis of rotation in either direction at an adjustable and programmable speed, and guide means in alignment with the axis of rotation of said support means for guiding wire as it is unwound from said reel, straightening means for straightening wire unwound from said reel, and take-up means for continuously drawing wire from said reel and through said guide means and straightening means, said take-up means comprising a first shaft, means for driving said first shaft in rotation, a second shaft coaxial with said first shaft and connected telescopically with said first shaft for rotation therewith but axial movement relative thereto, a drum on said second shaft, a threaded screw mounted for rotation parallel to said shafts, means for reversibly rotating said screw, a nut on said screw and means connecting said nut with said second shaft to move said second shaft and drum axially of said first shaft as said first shaft, second shaft and drum rotate.

5. A machine according to claim 4, in which said means for rotating said screw comprises a reversible, variable speed stepping motor.

* * * * *